United States Patent [19]

Ishii et al.

[11] 4,168,565

[45] Sep. 25, 1979

[54] METHOD FOR MANUFACTURING THERMIONIC CATHODE

[75] Inventors: Masaji Ishii, Tokyo; Shuzo Watanabe, Kawasaki; Akira Miyai; Hideo Hiraoka, both of Machida, all of Japan

[73] Assignee: Denki Kagaku Kogyo Kabushiki Kaisha, Tokyo, Japan

[21] Appl. No.: 898,401

[22] Filed: Apr. 20, 1978

Related U.S. Application Data

[62] Division of Ser. No. 798,243, May 18, 1977, Pat. No. 4,137,476.

[51] Int. Cl.[2] ..... H01J 9/04

[52] U.S. Cl. ..... 29/25.14; 29/25.18

[58] Field of Search ..... 29/25.14, 25.17, 25.18

[56] References Cited

U.S. PATENT DOCUMENTS

| | | | |
|---|---|---|---|
| 3,745,403 | 7/1973 | Misumi | 313/345 X |
| 3,823,337 | 7/1974 | van Stratum et al. | 313/346 R |
| 4,055,780 | 10/1977 | Kawai et al. | 313/346 R |

*Primary Examiner*—Richard B. Lazarus
*Attorney, Agent, or Firm*—Paul J. Sutton

[57] ABSTRACT

A method for manufacturing a thermionic cathode is provided which comprises cutting a bar from a multi-layer structure having a first layer of thermoelectron emissive compound and a third layer of metal of high melting point, a second layer of reaction barrier being interposed between said first and third layers, the bar being cut in a direction substantially perpendicular to that of the layers, sharpening the end of the first layer of the bar and then providing current terminals with the third layer of the bar. According to the method of the invention, a thermionic cathode capable of emitting stable electron beams of high intensity for a long period of time can be manufactured.

12 Claims, 6 Drawing Figures

METHOD FOR MANUFACTURING THERMIONIC CATHODE

This is a division of application Ser. No. 798,243, filed May 18, 1977 now U.S. Pat. No. 4,137,476.

BACKGROUND OF THE INVENTION

1. Field of the Invention

This invention relates to a method for manufacturing a thermionic cathode, and more particularly to a method for manufacturing a thermionic cathode from a multi-layer structure having a layer of thermoelectron emissive compound, a barrier layer and a layer of metal having high melting point.

2. Prior Art

In recent years there has been a need for electron beam of high intensity because of two purposes. One purpose is to utilize such electron beam for analyzers such as transmission electron microscope, scanning electron microscope or Auger spectroscopic analyzer in which electron beam is utilized. The other purpose is for use as an electron gun for electron beam rethography which is used instead of photorethography.

It is known from U.S. Pat. No. 2,639,399 that metal borides such as $CaB_6$, $SrB_6$, $BaB_6$, $LaB_6$, $CeB_6$ or $ThB_6$, particularly rare earth metal borides have small work function, thus exhibiting good thermoelectron emissive properties for use as cathodes in various electron beam devices. However, with most borides, particularly lanthanum hexaboride, it has been difficult to operate in stable conditions for a long time under elevated temperature required for the operation of electron beam devices since borides react with metal supporting the borides thereon.

Taking such reaction into consideration, a method has been proposed in U.S. Pat. No. 2,589,104 in which a tip of lanthanum hexaboride is supported on a cooled metal support and heated by a tungsten coil disposed around but spaced from said tip. Alternatively, in U.S. Pat. No. 2,807,695 there has been disclosed a structure having a reaction barrier material between an emitter tip of lanthanum hexaboride and a support metal, and provided with thermally decomposable graphite serving as a heater. However, the former device has a complicated structure and furthermore requires a large electric power upon operation, say 20 to 60 W because it utilizes indirect heating system, while in the latter device the thermally decomposable graphite deteriorates or softens at operation temperatures, hence not only resulting in unstable beam but also calling for large electric power. Therefore, notwithstanding these cathodes emitting electrons with high intensity, it has been difficult to apply such cathodes instead of hairpin type tungsten cathodes to electron beam analyzers.

OBJECTS AND SUMMARY OF THE INVENTION

An object of the present invention is to provide a method for manufacturing a thermionic cathode of direct heating type which is capable of emitting stable electron beams of high intensity.

Another object of the present invention is to provide a method for manufacturing a thermionic cathode capable of emitting stable electron beams of high intensity for a long period of time with reduced electric power.

A still another object of the present invention is to provide a method for manufacturing a thermionic cathode in a simple way.

These and other objects will become apparent with reference to the following description.

According to the method of the present invention, a bar is cut or punched out from a multi-layer structure having a first layer of thermoelectron emissive compound and a third layer of metal having high melting point, a second layer of reaction barrier being interposed between said first and third layers. The bar is cut or punched out substantially in a perpendicular direction relative to the direction of the layers so that the bar has three layers above referred to. Then the end of the first layer in the bar is sharpened and current terminals are fixed to the third layer of the bar.

PREFERRED EMBODIMENT OF THE INVENTION

Figure 1:
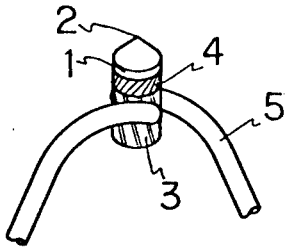
FIG. 1 is a schematic view showing a thermionic cathode made in accordance with the method of the present invention.

Referring to FIG. 1, reference numeral 1 denotes a first layer of thermoelectron emissive compound such as lanthanum hexaboride, the tip 2 of which is sharply sharpened by mechanical grinding or electrolytic etching so that the radius of curvature of the tip has approximately 1 to 20 $\mu$m. The first layer 1 is supported by a third layer 3 of metal having high melting point such as tungsten, tantalum or molybdenum, a second layer 4 of reaction barrier being interposed between the first and third layers 1, 3. Heating wires or conductors 5 are welded to the third layer 3 of the three layer structure. The wires 5 may be welded to the barrier layer 4. However, it is not preferable to weld the wires to the first layer 1 since chemical reactions would be caused at the operation temperature.

The three layer structure of thermoelectron emissive material, barrier material and metal of high melting point may be manufactured in any known manners. For example, the following methods may be utilized:

(1) After sintering powders of thermoelectron emissive material, barrier material and metal of high melting point to form sintered bodies having predetermined thickness, respectively, each sintered body is placed in vertical alignment and then hot pressed to obtain the three layer structure.

(2) After sintering powders of thermoelectron emissive material and metal of high melting point to form sintered bodies having predetermined thickness, respectively, powders of reaction barrier material are put between the sintered bodies of thermoelectron emissive material and metal of high melting point and then hot pressed to obtain the three layer structure.

(3) A slurry containing reaction barrier material is applied to a metal plate of high melting point, thereafter powders of thermoelectron emissive material are put on the metal plate and then hot pressed to obtain the three layer structure.

While which method is suitably used depends upon the varieties of thermoelectron emissive materials, barrier materials and metals of high melting point, if the hot pressing method is applied to the step or steps for manufacturing the multi-layer structure, the sintered bodies obtained have fine grained dense structure and the three layers are firmly bonded thermally as well as mechanically so that the layers will not peel off easily. For hot pressing conditions such temperature, pressure and period of time are required that the thermoelectron emissive material is sufficiently sintered to form a fine grained dense body and that the three layers are firmly bonded together. In general, a temperature of 1800° to 2200° C., a pressure of 100 to 500 kg/cm$^2$ and a period of 1 hr. are required.

When the temperature upon hot pressing is below 1800° C., neither porosity necessary for thermionic cathode nor strong bonding between the layers are obtained. On the other hand, when the temperature exceeds 2200° C., exaggerated grain growth tends to be caused so that the laminate structure having large coarse grains, hence mechanically weak strength is obtained.

Below a pressure of 100 kg/cm$^2$, a preferred sintered body is not obtained within the temperature range above referred to, whereas above 500 kg/cm$^2$ the graphite dies cannot stand upon hot pressing pressure. The relationship between these conditions is shown in the following table. Incidentally, the hot pressing was effected under vacuum or inert gas atmosphere.

Table

| Temp. °C. | Pressure kg/cm$^2$ | Period of time hr. | Pore percentage of sintered $LaB_6$ % (porosity) | Bonding, etc. |
|---|---|---|---|---|
| 1700 | 250 | 1 | 25 | X |
| 1900 | 250 | 1 | 16 | 0 |
| 2100 | 250 | 1 | 5 | 0 |
| 2300 | 250 | 1 | 0 | Exaggerated grain growth |
| 2100 | 50 | 1 | >20 | X |
| 2100 | 500 | — | | Graphite dies broken |

Figure 2:
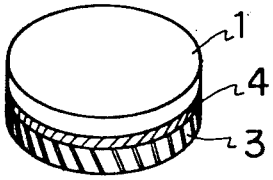
FIG. 2 is a perspective view schematically showing a multi-layer plate or disc made in accordance with the method of the present invention.
Figure 3:
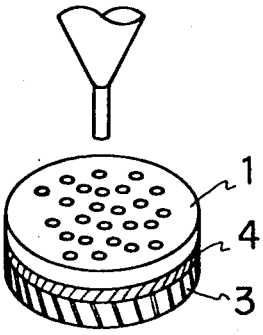
FIG. 3 is a perspective view in which bars are being cut by means of a ultrasonic cutting machine.

The three layer structure manufactured by the hot pressing method is shown in FIG. 2. A round bar having a diameter of about 0.1 to 1 mm is punched or cut out through the layer structure in a direction perpendicular to that of the layers of the laminate structure by means of a ultrasonic cutting machine or electron discharge machine. Alternatively, a square bar having a side length of about 0.5 to 1 mm may be cut out with a diamond cutter. Referring to FIG. 3, the round bars are being cut or punched out by the ultrasonic cutting machine. The bar thus obtained has a structure in which the barrier layer 4 is metallurgically firmly bonded between the first layer 1 of thermoelectron emissive material and the third layer 3 of high melting metal, as shown in FIG. 4.

Figure 4:
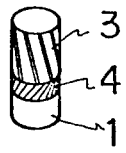
FIG. 4 is a schematic view showing a bar cut out from the multi-layer plate or disc according to the invention.
Figure 5:
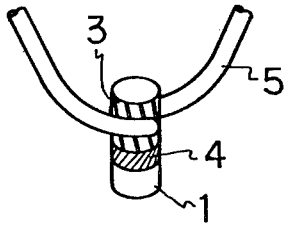
FIG. 5 is a perspective view schematically showing a bar provided with current terminals in accordance with the present invention.

The bar shown in FIG. 4 is washed with an organic solvent and the like, thereafter two heating wires or conductors 5 are welded to the third layer 3 by means of a spot welder of the resistance type or an electron beam welder. Then the first layer 1 is immersed into an electrolyte for electrolytic etching, after which the first layer 1 is anodized to have a sharp tip having the radius of curvature of 1 1 to 20 μm. As the electrolyte, a liquid of hydrofluoic acid-nitric acid-acetic acid-methanol system is preferred. In case of the bar having a diameter of, for example 0.2 mm. upon electrolytic etching, it is possible to etch the bar at 2 to 8 V for 50 to 60 sec. It is convenient to make use of the wires 5 which have been welded in the previous step hereinbefore described when introducing electric current upon electrolytic etching.

In case where the end of the first layer 1 is sharpened by mechanical processing, the layer 1 is ground and cut out with a diamond grinder before the heating wires or conductors 5 are welded so that the tip has a cone angle of 45° to 90° and the radius of curvature of 1 to 20 μm. After electrolytic etching or mechanical processing, the structure is washed and dried to obtain a thermionic cathode shown in FIG. 1.

The thermoelectron emissive material which can be used in accordance with the present invention includes alkali earth metal borides and rare earth metal borides having a general formula of $MeB_6$ wherein Me denotes alkali earth metal or rare earth metal, such as barium hexaboride ($BaB_6$), calcium hexaboride ($CaB_6$), lanthanum hexaboride ($LaB_6$), yttrium hexaboride ($YB_6$), samarium hexaboride ($SmB_6$) or gadolinium hexaboride ($GdB_6$). Of these compounds $LaB_6$ is most preferred.

The metals having high melting point preferably include tantalum (Ta), tangusten (W), molebdenum (Mo) and rhenium (Re).

As hereinbefore described, any material may be used for the barrier layer 4 if the material hardly reacts with the thermoelectron emissive material and the metal of high melting point and if the material has a melting point of above 1900° C. and an equilibrium vapour pressure of $10^{-5}$ torr or less. A series of experiments have been made to seek for a proper barrier material by placing various barrier materials between the first and third layers and then hot pressing the same together. As a result, it has been found that borides such as zirconium boride ($ZrB_2$), titanium boride ($TiB_2$), tantalum boride ($TaB_2$) or niobium boride ($NbB_2$) carbides such as zirconium carbide (ZrC) or Tantalum carbide (TaC) and nitrides such as zirconium nitride (ZrN) or tantalum nitride (TaN) are preferred and that the most preferable materials are $ZrB_2$, $TiB_2$ and TaC.

The invention will be further illustrated in the following examples.

EXAMPLE I

Powders of $LaB_6$ having an average grain diameter of 4.4 μm were hot pressed in vacuum at 2050° C. under 400 kg/cm$^2$ for an hour and a disc having a diameter of 25 mm and a thickness of 5 mm was obtained. Alternatively, a disc having a diameter of 25 mm was cut out from a tantalum plate having a thickness of 1 mm. The surfaces of the resulting sintered body of $LaB_6$ and the tantalum plate were ground to have smooth surfaces, thereafter powders of $ZrB_2$ were put between the body and the plate in such an amount that the resulting second layer of $ZrB_2$ has a thickness of 0.5 mm by hot pressing. Then these materials were placed in a graphite die having an inner diameter of 25 mm, an outer diameter of 70 mm and a height of 100 mm and subsequently hot pressed under vacuum at 2100° C. under 400 kg/cm$^2$ for one hour. After taking out from the die, the upper and under surfaces were ground so that the $LaB_6$ layer is 1 mm thick and the Ta layer is 0.5 mm thick. Accordingly, a disc of three layer structure (diameter of 25 mm, thickness of 2 mm) was obtained, as shown in FIG. 2.

Then, from the three layer disc a cathode bar having a diameter of 0.4 mm and a thickness of 2 mm was punched out by means of a ultrasonic cutting machine having a hollow stainless tube of inner diameter of 0.4 mm and an outer diameter of 1 mm. The $LaB_6$ layer of this bar was mechanically ground so as to have a cone angle of 60° and the radius of curvature of the tip of 10 μm. Final size of the chip was 0.4 mm in diameter and 1.5 mm in height. Next, the cathode chip was washed in trichlene for five minutes and subsequently in ethanol for the same period in a ultrasonic bath. After drying wires of tantalum having a diameter of 0.2 mm was spot welded to the Ta layer of the chip, as shown in FIG. 1.

Figure 6:
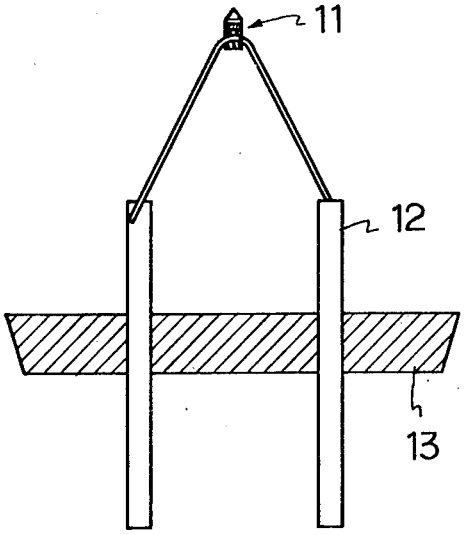
FIG. 6 is a schematic view in which a thermionic cathode made in accordance with the present invention is fixed on a mount for use as a cathode in an electron microscope.

As shown in FIG. 6, the chip or cathode 11 was secured to electrodes 12 fixed to a mount 13 for use as a thermionic cathode of electron microscope. The cathode was adapted to an electron gun in the microscope. The experiment was effected at an accelerated voltage of 25 KV. The tip of the cathode could be heated to a temperature of 1900° K. at an input of 2 V and 3 A (=6 W). The cathode could be operated stably for 200 hours at a brightness of $1.2\times10^5$ A/Cm$^2$ Str. Incidentally, where a conventional hairpin type cathode of tangusten was used, the cathode was broken after using 40 hours even at a low brightness of $2.5\times10^4$ A/cm$^2$ Str.

EXAMPLE 2

From a plate of tantalum having a thickness of 1 mm, a disc of diameter of 25 mm was cut out and the surfaces of the disc was ground smoothly. A slurry containing $TiB_2$ was applied to the disc with a spray gun. Powders of $LaB_6$ and the tantalum plate to which $TiB_2$ had been applied were placed in the graphite mold and hot pressed at 2000° C. under 400 kg/cm$^2$ for one hour. Thereafter, a thermionic cathode was made in the same manner as described in Example 1. Electron beam of high intensity was obtained.

Comparative Example

In comparison of the present invention, a cathode which did not have a barrier layer was subjected to experiment.

In a mold of graphite a tantalum plate having a diameter of 25 mm and a thickness of 1 mm was placed. Without interposing barrier material powders of $LaB_6$ were put on the plate and hot pressed at 2000° C. under 400 kg/cm$^2$ for one hour. After taking out from the mold, there was found a reaction between the two layers. After leaving only for a week at room temperature, efflorescence was caused. After all, a laminate of which thermionic cathode could be made could not be manufactured at all.

Although the present invention has been described with particular reference to preferred embodiments, it will be apparent that variations and modifications may be made without departing from the essential spirit and scope of the invention. It is intended to include all such variations and modifications.

What is claimed is:

1. A method for manufacturing a thermionic cathode which comprises cutting a bar from a multi-layer structure having a first layer of a thermoelectron emissive compound and a third layer of metal of high melting point, a second layer of reaction barrier being interposed between said first and third layers and being selected from one or more of the group consisting of borides and nitrides and having relatively high melting point and electrically conducting properties, the bar being cut in a direction substantially perpendicular to that of the layers, sharpening the end of the first layer of the bar to a point and then providing current terminals integral the third layer of the bar.

2. The method as claimed in claim 1 wherein the thermoelectron emissive compound has a general formula of $MeB_6$ wherein Me represents alkali earth metal or rare earth metal.

3. The method as claimed in claim 2 wherein the alkali earth metal is selected from the group consisting of barium and calcium.

4. The method as claimed in claim 3 wherein the alkali earth metal is barium.

5. The method as claimed in claim 2 wherein the rare earth metal is selected from the group consisting of lanthanum, yttrium, samarium and gadolinium.

6. The method as claimed in claim 5 wherein the rare earth metal is lanthanum.

7. The method as claimed in claim 1 wherein the metal of high melting point is selected from the group consisting of tantalum, tangusten, molybdenum and rhenium.

8. The method as claimed in claim 1 wherein the reaction barrier material is selected from one or more of the group consisting of borides, carbides and nitrides having high melting points and electrically conducting properties.

9. The method as claimed in claim 8 wherein the reaction barrier material is selected from one or more of the group consisting of zirconium boride ($ZrB_2$), titanium boride ($TiB_2$) and tantalum carbide (TaC).

10. The method as claimed in claim 1 wherein the bar is cut out by means of ultrasonic cutting, electron discharge cutting or diamond cutting.

11. The method as claimed in claim 1 wherein the bar is sharpened by diamond cutting or electrolytic etching.

12. The method as claimed in claim 1 wherein when manufacturing said multi-layer structure, the first, second and third layers are hot pressed under a pressure of 100 to 500 kg/cm$^2$ at a temperature of 1800° to 2200° C. under vacuum or inert gas atmosphere.

* * * * *